US006595137B1

(12) United States Patent
Karlsson

(10) Patent No.: US 6,595,137 B1
(45) Date of Patent: Jul. 22, 2003

(54) ARRANGEMENT FOR CHARGING ENERGY IN AN ENERGY-STORING ARRANGEMENT SUCH AS AN IGNITION CAPACITOR

(75) Inventor: Peter Karlsson, Mölndal (SE)

(73) Assignee: Saab AB, Linköping (SE)

( * ) Notice: Subject to any disclaimer, the term of this patent is extended or adjusted under 35 U.S.C. 154(b) by 0 days.

(21) Appl. No.: 09/889,905

(22) PCT Filed: Jan. 3, 2000

(86) PCT No.: PCT/SE00/00001

§ 371 (c)(1),
(2), (4) Date: Oct. 9, 2001

(87) PCT Pub. No.: WO00/45122

PCT Pub. Date: Aug. 3, 2000

(30) Foreign Application Priority Data

Jan. 28, 1999 (SE) ..... 9900266

(51) Int. Cl.[7] ..... F23Q 7/02; F23Q 21/00; F42C 21/00

(52) U.S. Cl. ..... 102/215; 102/206

(58) Field of Search ..... 102/206, 215, 102/218

(56) References Cited

U.S. PATENT DOCUMENTS 3,853,063 A * 12/1974 Hoyt et al. ..... 102/70.2 R
4,227,461 A * 10/1980 Beezley et al. ..... 102/218
4,246,845 A 1/1981 Winton et al. ..... 102/206
4,962,706 A * 10/1990 Ivermee et al. ..... 102/206
5,113,766 A * 5/1992 Grosch ..... 102/206
5,476,044 A * 12/1995 Boucher ..... 102/218

FOREIGN PATENT DOCUMENTS

DE 3042247 5/1982
GB 2169994 * 7/1986 ..... 102/206

* cited by examiner

*Primary Examiner*—Michael J. Carone
*Assistant Examiner*—H. A. Blackner
(74) *Attorney, Agent, or Firm*—Swidler Berlin Shereff Friedman, LLP

(57) ABSTRACT

The present invention provides an arrangement for charging energy in an energy-storing arrangement such as an ignition capacitor in electronic ignition systems. To reduce the risk of malfunction, direct-current-controlled breakers controlled by environmental conditions, normally occurring on the primary side of a transformer (4) in series with the primary winding (5) have been replaced by a frequency divider (2) controlled by environmental conditions. This frequency divider divides down a signal supplied by a signal generator (1) pulse train with a lower frequency which controls a breaker (7) connected in series with the primary winding (5) of the transformer.

13 Claims, 6 Drawing Sheets

| Frequency of the output signal of the frequency divider | multivibrator 24 | multivibrator 25 |
|---|---|---|
| low frequency | low | low |
| correct frequency | low | high |
| high frequency | high | high |

Fig. 6

ARRANGEMENT FOR CHARGING ENERGY IN AN ENERGY-STORING ARRANGEMENT SUCH AS AN IGNITION CAPACITOR

FIELD OF THE INVENTION

The present invention provides an arrangement for charging energy in an energy-storing arrangement such as an ignition capacitor in an electronic ignition system, which energy-storing arrangement is connected to the secondary side of a transformer, the primary side of which is connected to a direct-voltage source in series with a first breaker controlled by a pulse train.

BACKGROUND OF THE INVENTION

Energy-storing arrangements of the ignition-capacitor type are used in, among other things, the functional part of projectiles in order to ignite the functional part after an ignition pulse has been received. For safety reasons, it should only be possible to charge the ignition capacitor when a number of environmental conditions have been fulfilled. One environmental condition can be that the projectile has been exposed to an acceleration pulse of a certain magnitude. Another can be that the projectile has begun to rotate. To handle the problems of environmental conditions, there is normally a number of mechanical and/or electrical breakers between the batteries for the ignition capacitors' charging and the ignition capacitor itself.

According to GB 2 169 994 A, a first example of a charging arrangement is previously known. According to this patent document, a transformer is used to increase the battery voltage before it charges up, for example, an ignition capacitor. In series with the primary winding of the transformer, a plurality of breakers is inserted which are controlled by environmental conditions. There is also a breaker, which is controlled by a pulse train in order to generate an alternating voltage on the primary side of the transformer. The breakers controlled by environmental conditions operate with normal direct-current signals.

A similar charging arrangement is also known from U.S. Pat. No. 5,476,044. A breaker, which is supplied with energy from the secondary side of the transformer, opens and closes the feed of the primary side of the transformer in order to form low-voltage pulses through the primary winding of the transformer from the direct voltage from the direct-voltage source on the primary side. Environmental conditions control the breakes in series with the primary winding of the transformer. The breakers controlled by environmental conditions operate with normal direct-current signals.

A breaker of the type given in known charging arrangements according to the above is controlled by direct voltages. In the case of a fault in, the control electronics, a breaker can therefore be closed without corresponding environmental conditions being fulfilled.

SUMMARY OF THE INVENTION

It is the object of the present invention to provide a charging arrangement where the risk of a malfunction is considerably reduced in relation to known charging arrangements with direct-voltage-controlled breakers.

The object of the invention is achieved by an arrangement characterized by the following, for generating the pulse train for controlling the first breaker, a signal generator and a frequency device connected to the signal generator controlled by environmental conditions of the ignition system, are included. The charging arrangement according to the invention generates the pulse train as a result of the environmental conditions which control the frequency of the pulse train which is coupled to the control of the first breaker connected in series with the primary winding of the transformer. In the charging arrangement according to the invention, therefore, it is no longer necessary to have breakers controlled by environmental conditions in series with the primary winding. The problem with malfunctions in direct-current breakers has thus been eliminated. However, this does not exclude a use of other breakers in series with the primary and secondary winding of the transformer as in GB 2 169 994 A.

The signal generator advantageously comprises the clock of the ignition system which normally operates within a suitable frequency range for being divided down in frequency. For example, the clock can operate with a frequency of 10 MHz, which is divided down to a frequency range of 10–100 kHz. Using the clock of the ignition system also means that the cost for a separate component as well as space can be saved.

According to an advantageous embodiment, a band-pass filter is coupled in between the frequency divider and the control input of the first breaker in order to attenuate signals outside a specified operating interval. The operating interval can be set to be narrow if the clock and the frequency divider operate with a great accuracy and only a specific state of environmental condition is accepted. Alternatively, the bandwidth of the band-pass filter can be increased in order to allow, for example, several specific states of environmental condition.

To further increase the safety in the ignition system, a second breaker is coupled in between the output of the frequency divider and the control input of the first breaker according to another advantageous embodiment.

According to a first further development of the embodiment with a second breaker, a control element is arranged to check the environmental conditions of the ignition system and, based on the result of the check, to control the second breaker to the closed position with approved environmental conditions and to the open position with environmental conditions which are not approved. The checking element advantageously consists of logic circuits.

According to a second further development of the embodiment with a second breaker, a frequency comparator arrangement is arranged to measure the frequency on the output side of the frequency divider and to control the second breaker to the closed position within frequencies which are suitable for the frequency divider and to the open position outside frequencies suitable for the frequency divider. The frequency comparator arrangement can advantageously comprise a frequency calculator for determining the frequency at the output of the frequency divider, a memory for storing frequencies which are suitable for the frequency divider and a comparator circuit for comparing the frequency found with suitable frequencies and controlling the second breaker on the basis of the result. Alternatively, the frequency comparator arrangement can comprise a first monostable multi-vibrator in series with a first D flip-flop and a second monostable multi-vibrator in series with a second D flip-flop, which first multi-vibrator is designed with a pulse length defining a lower limit frequency and which second multi-vibrator is designed with a pulse length defining an upper limit frequency for the current frequencies of the frequency divider. For determining the pulse lengths of the multi-vibrators, a resistor and a capacitor is advantageously arranged at the input of each multi-vibrator. The plausibility of the frequency of the pulse train is checked in a simple manner and the pulse train is only connected through if its frequency is determined to be plausible.

According to yet another advantageous embodiment, the primary side of the transformer comprises a winding with a centre tap connected to the direct-voltage source, which winding is connected symmetrically in series with the first breaker and a further breaker. This embodiment produces a symmetric feeding of the primary side of the transformer.

BRIEF DESCRIPTION OF THE DRAWINGS

This invention will be described in greater detail below by means of some illustrative embodiments, referring to the attached drawings, in which:

FIG. 6 illustrates the functions of multi-vibrators used in the frequency comparator arrangement according to FIG. 5.

DETAILED DESCRIPTION OF THE INVENTION

Figure 1:
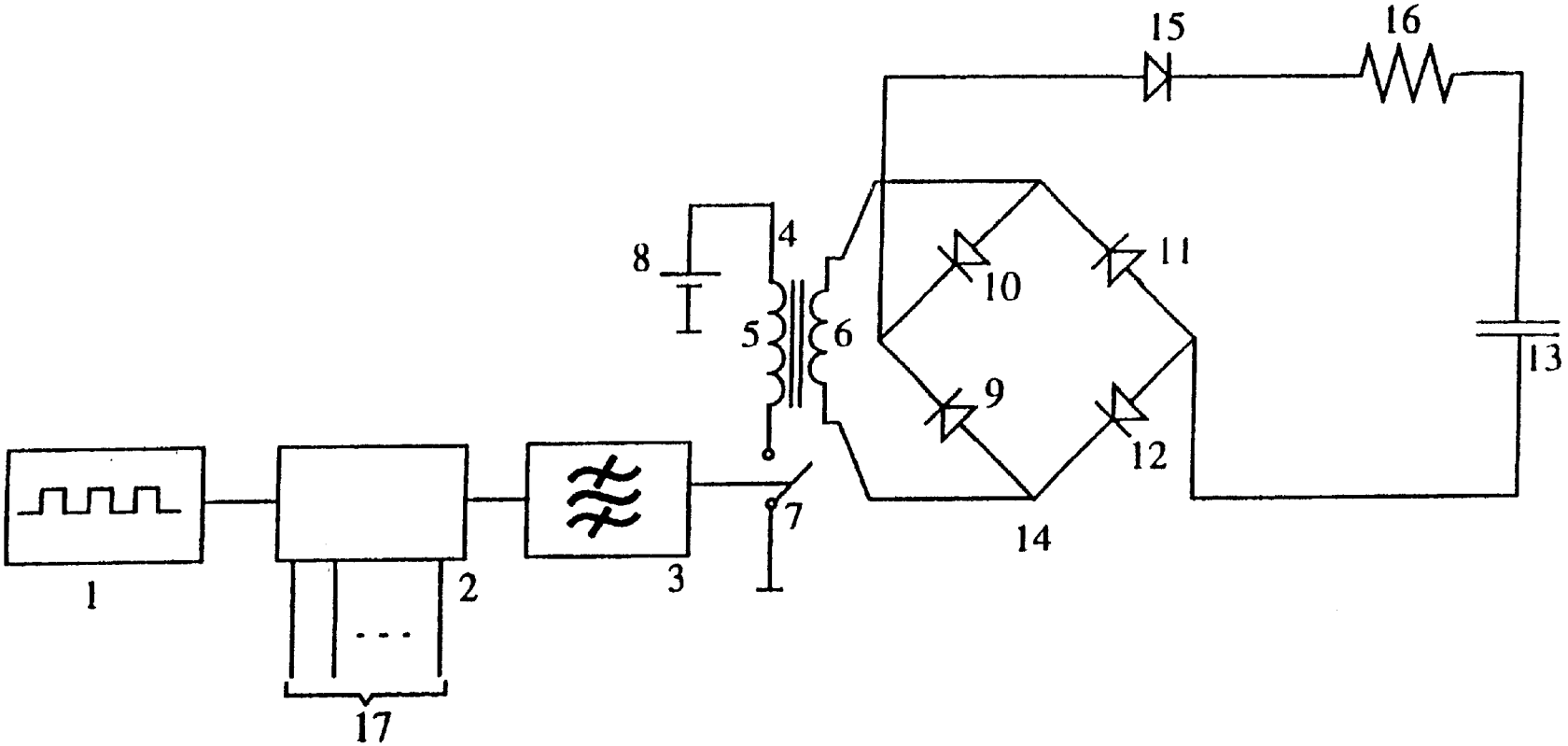
FIG. 1 shows a first illustrative embodiment of a charging arrangement according to the invention.

According to the illustrative embodiment shown in FIG. 1, a signal generator 1, a frequency divider 2 and a band-pass filter 3 are arranged on the primary side of a transformer 4 with a primary winding 5 and a secondary winding 6. The signal generator can be provided with a clock in an ignition system in which the charging arrangement is included. The output of the band-pass filter 3 is connected to the control input of a breaker 7 which is connected in series with the primary winding 5 of the transformer. There is also a direct-voltage source or battery 8 in series with the primary winding of the transformer. On the secondary side of the transformer there is a rectifier circuit 14 for converting alternating voltage transferred through the transformer. The rectifier circuit 14 comprises a bridge circuit with four diodes 9, 10, 11 and 12. An ignition capacitor 13 included in the ignition system is coupled to the bridge circuit 14, in the manner shown, in series with a diode 15 and a resistor 16.

The following description provides the basic operation of the charging arrangement. From the signal generator 1, a signal, for example of the order of magnitude of 10 MHz, is output to the frequency divider 2. The frequency divider 2 is supplied with information about the environmental condition by inputs 17. The information can consist, for example, of a digital code of ones and zeros. For codes which represent acceptable environmental conditions, the frequency of the incoming signal is divided to a frequency within the pass band of the band-pass filter 3, for example of the order of magnitude of 10–100 kHz. Any signals, the frequency of which lies outside the pass band of the band-pass filter is attenuated in such a manner, that the breaker 7 is not closed. This arrangement forms an alternating voltage in the transformer 4 which is rectified in the rectifier circuit 14 on the secondary side before it charges up the ignition capacitor 13. After that, the energy stored in the ignition capacitor 13 can be utilized for igniting, for example an electrical detonating cap.

Figure 2:
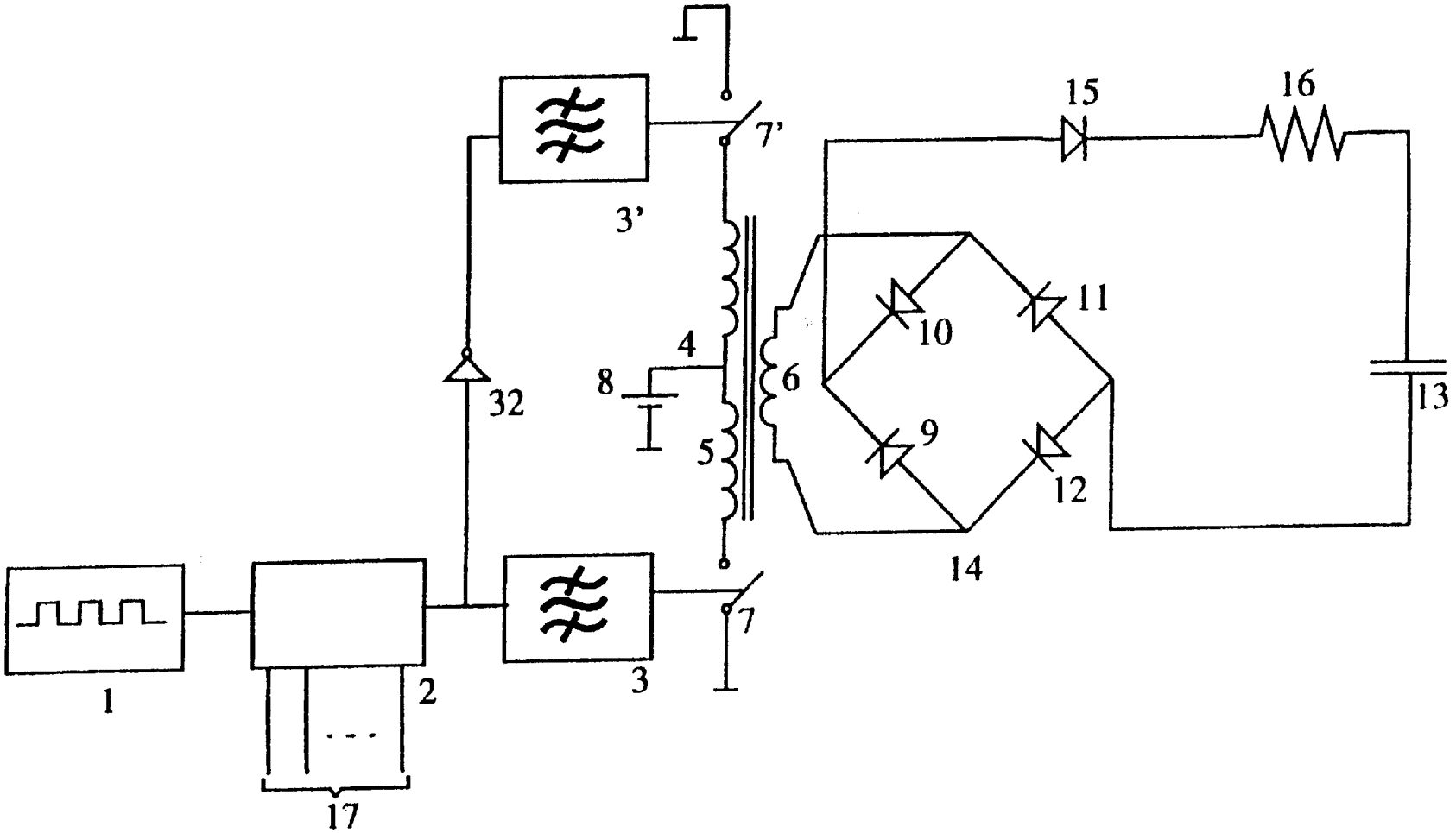
FIG. 2 shows a second illustrative embodiment of a charging arrangement according to the invention.

FIG. 2 shows a modification of the embodiment according to FIG. 1. The components which correspond to those in the embodiment described with regard to FIG. 1 are given the same reference designations and will not be described any further. To produce a symmetrical feeding of the primary side from the battery 8, the primary winding 5 is provided with a centre tap to which the battery 8 is connected. Two breakers 7 and 7' controlled from the frequency divider 2 via the intermediate band-pass filter 3 and 3' are connected in series with and symmetrically with respect to the primary winding 5. An inverter 32 is inserted in series with one of the band-pass filters, in this case filter 3'. With frequencies within the frequency range of the filters 3, 3', the breakers 7, 7' will be opened and closed in opposite phase.

Figure 3:
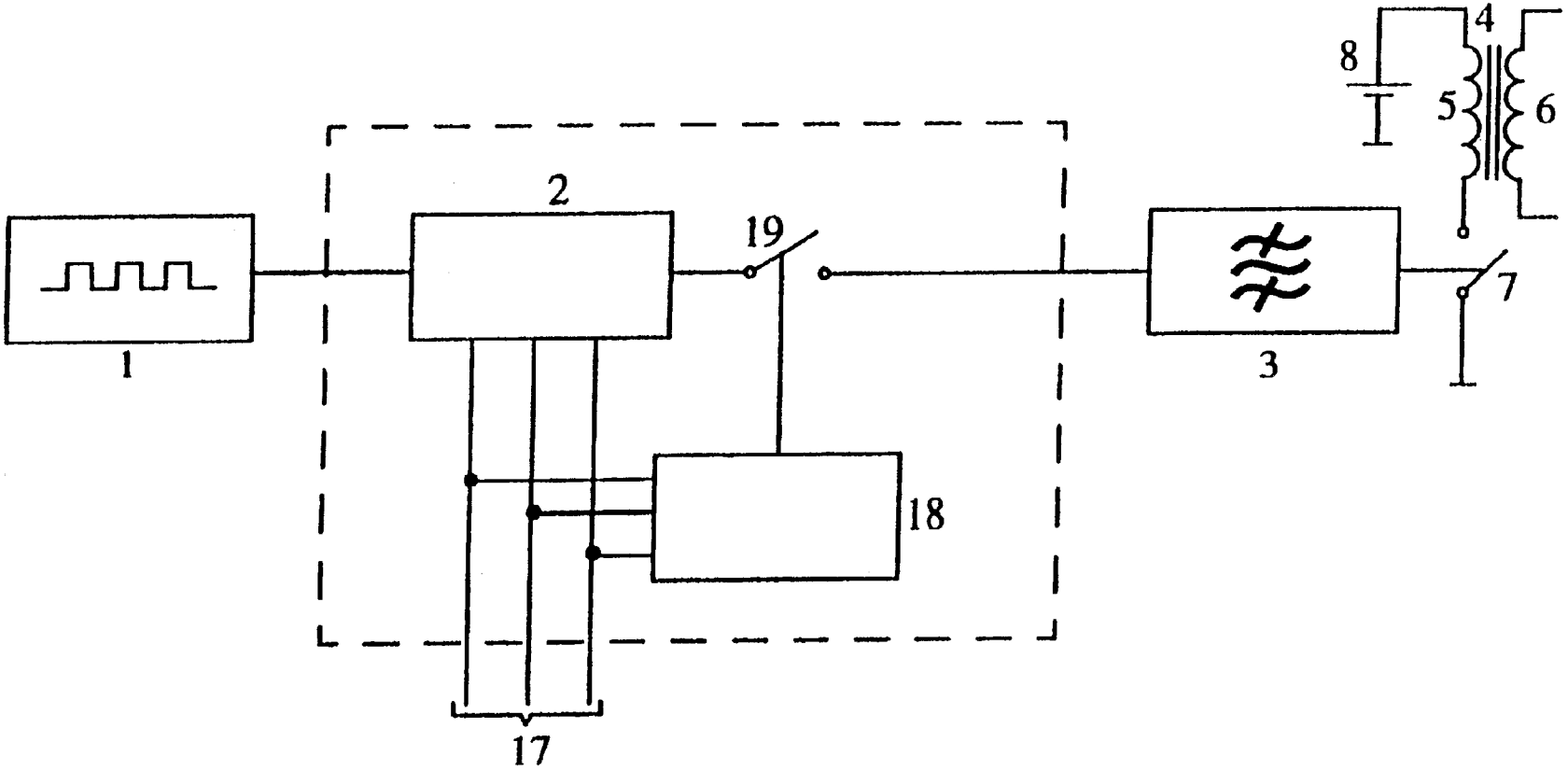
FIG. 3 shows a third illustrative embodiment of a charging arrangement according to the invention.

In the illustrative embodiment shown in FIG. 3, a checking element 18 and a second breaker 19 are introduced. The checking element 18 senses the code at inputs 17 of the frequency divider 2 and controls the breaker 19. The checking element can be constructed of a number of logic circuits of conventional type, not shown. It can be noted, that the environmental conditions which control the checking element 18 do not need to be identical with the environmental conditions which control the frequency divider. On the secondary side, charging circuits can be constructed in accordance with FIG. 1. It can be pointed out, however, that other alternative embodiments are conceivable for all illustrative embodiments described in this text.

Figure 4:
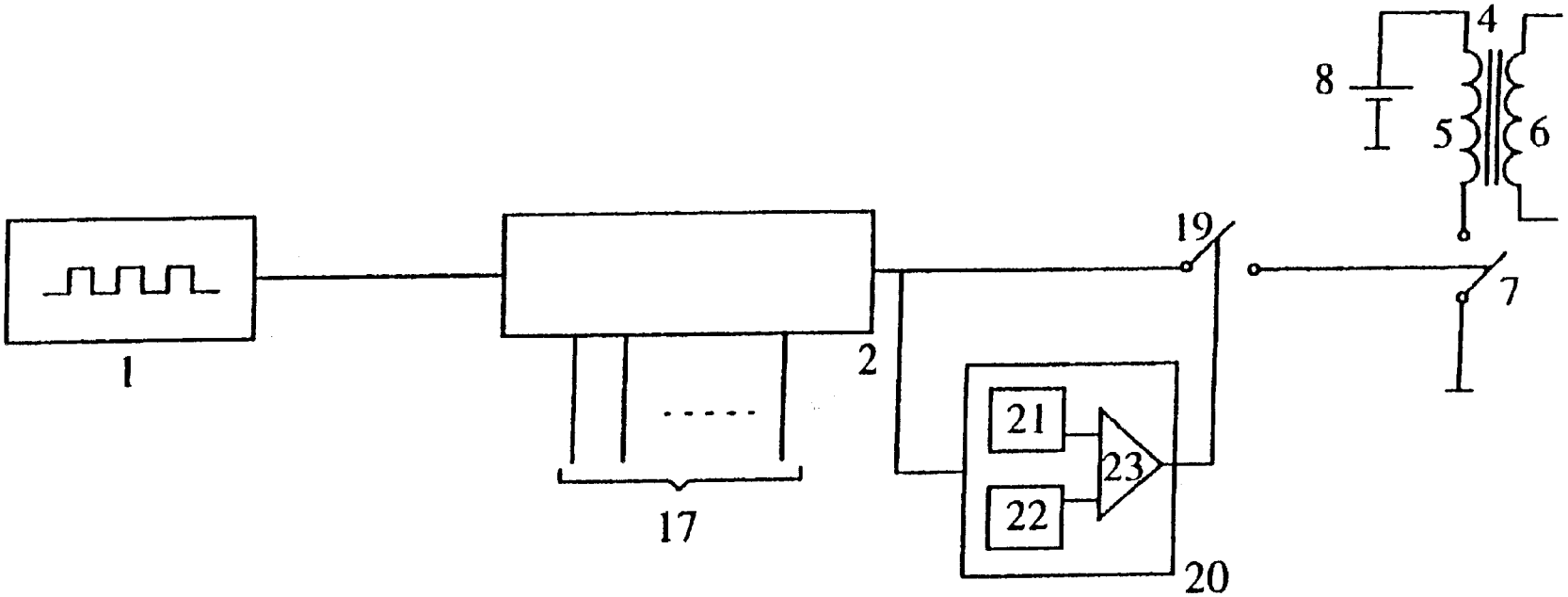
FIG. 4 shows a fourth illustrative embodiment of a charging arrangement according to the invention.

The embodiment proposed in FIG. 4 includes a frequency comparator arrangement 20 and a breaker 19. The arrangement 20 can comprise a frequency calculator 21 for determining the frequency at the output of the frequency divider 2, a memory 22 for storing frequencies suitable for the frequency divider which will allow the ignition capacitor to be charged and a comparator circuit 23 for comparing the frequency found with stored frequencies and controlling the breaker 19. When the detected frequency and the frequency stored in the memory correspond, the pulse train is coupled through to the breaker 7 in series with the primary winding 5.

Figure 5:
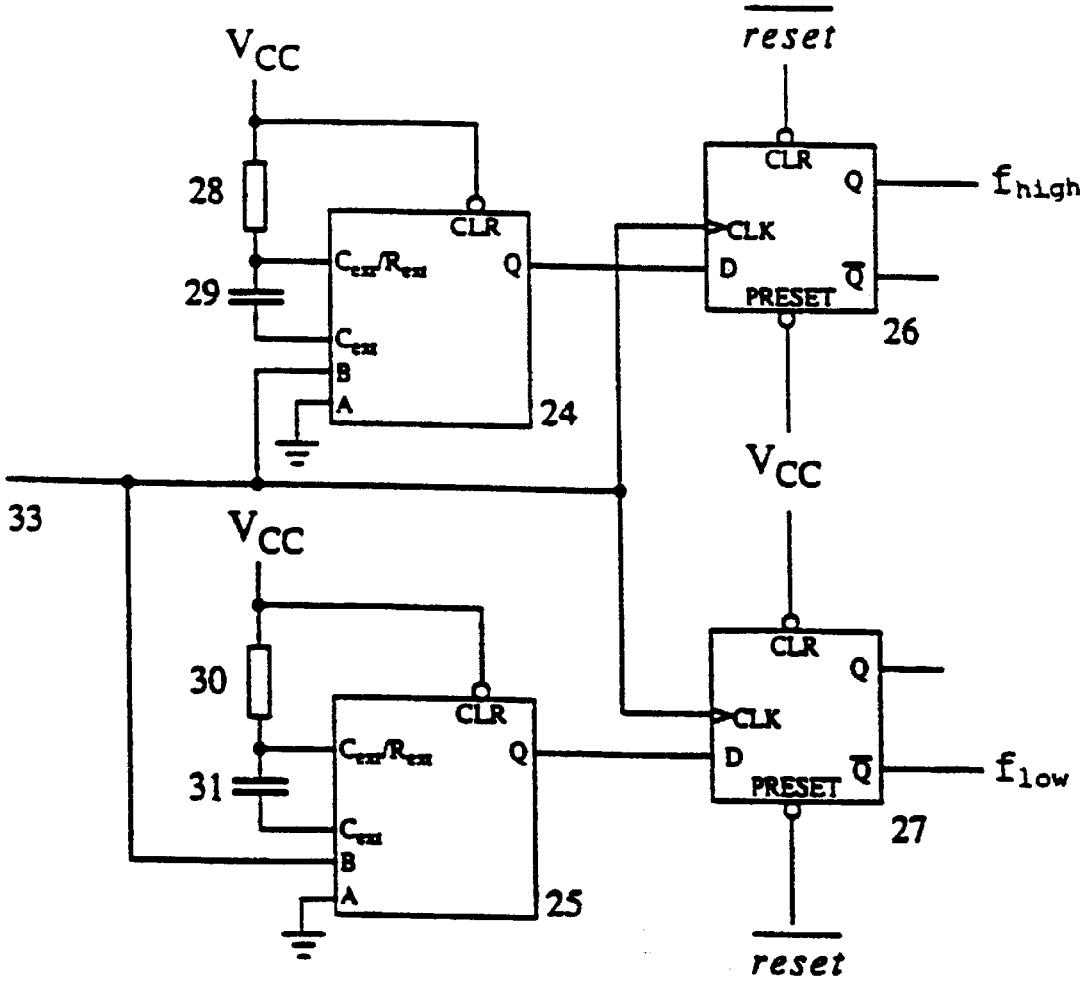
FIG. 5 shows an alternative embodiment of a frequency comparator arrangement shown in FIG. 4 used in the charging arrangement according to the invention.

To check that the output frequency from the frequency divider 2 lies within an approved interval, a single check circuit according to FIG. 5 can alternatively be used. The circuit comprises two retriggerable monostable multi-vibrators 24, 25, two D flip-flops 26, 27, a first resistor 28 and a first capacitor 29 at the input of the multi-vibrator 24 and a second resistor 30 and a second capacitor 31 at the input of the multi-vibrator 25. The check circuit is connected through clock input 33 to the output of the frequency divider 2. The clock input 33 is connected to multi-vibrators 24, 25 and the clock inputs of D flip-flops 26, 27. A direct voltage $V_{cc}$ feeds components included in the check circuit in the manner shown in FIG. 5. When a multi-vibrator is triggered at the input by the output signal of frequency divider 2, a pulse is generated at the output of the multi-vibrator, the length of which is determined by the resistor 28 and the capacitor 29 for the multi-vibrator 24, and the resistor 30 and the capacitor 31 for the multi-vibrator 25. If an additional trigger pulse comes within a time corresponding to the pulse length, the output continues to be high for a time corresponding to the pulse length calculated from the last triggering time. This means that if the time of the period of the output signal is shorter than the pulse length of the multi-vibrator, the output from the multi-vibrator will be constantly high. Otherwise, the output signal is low at the triggering time.

The pulse lengths of the multi-vibrators 24 and 25 are then selected in such a manner that the multi-vibrator 24 provides a pulse which corresponds to the shortest period which is acceptable whilst multi-vibrator 25 provides a pulse which corresponds to the longest period which is acceptable for the output signal from the frequency divider 2. If the frequency of the output signal from the frequency divider is to be accepted, it is a requirement, that the output signal from the multi-vibrator 24 should be low whilst the output signal from the multi-vibrator 25 should be high at each triggering time.

The table shown in FIG. 6 relates to the output signals from the multi-vibrators 24 and 25 at the triggering time for the case where the output signal frequency is too low, acceptable and too high. By sampling the output signals from both multi-vibrators 24, 25 at the positive edge of the output signal from the frequency divider it is therefore possible to check that the output signal of the frequency divider is within an acceptable frequency interval. This sampling is done with the aid of the D flip-flops 26, 27, which are triggered at the positive edge and then read in the values at the outputs of the multi-vibrators 24, 25. $F_{high}$ therefore signals that the frequency is too high and $F_{low}$ signals that the frequency is too low. The value read in lies at the output of the D flip-flop until the next positive edge triggers the flip flop again. A conventional logic circuit, not shown, can form the control signal for breaker 19 on the basis of these two signals. Another alternative is also to use a breaker in series with the breaker 19 and to let the D flip-flops each control a breaker.

The charging arrangement described above is not limited to the illustrative embodiments described but a plurality of modifications are possible within the scope of the invention as defined in the patent claims following.

What is claimed is:

1. An arrangement for charging energy in an energy-storing arrangement, which energy-storing arrangement is connected to the secondary side of a transformer, the primary side of which is connected to a direct-voltage source in series with a first breaker controlled by a pulse train, characterized in that, for generating the pulse train for controlling the first breaker, a signal generator and a frequency divider controlled by environmental conditions of an ignition system, connected to the signal generator, are included, wherein a second breaker is coupled in between the output of the frequency divider and the control input of the first breaker.

2. Arrangement according to claim 1, characterized in that the signal generator comprises a clock of the ignition system.

3. Arrangement according to claim 1, characterized in that a band-pass filter is coupled in between the frequency divider and the control input of the first breaker in order to attenuate signals outside a specified operating interval.

4. Arrangement according to claim 1, characterized in that a checking element is arranged to check the environmental conditions of the ignition system and, based on the result of the check, to control the second breaker to the closed position with approved environmental conditions and to the open position with environmental conditions which are not approved.

5. Arrangement according to claim 4, characterized in that the checking element consists of logic circuits.

6. Arrangement according to claim 1, characterized in that a frequency comparator arrangement is arranged to measure the frequency on the output side of the frequency divider and to control the second breaker to the closed position for frequencies within frequencies suitable for the frequency divider and to the open position outside frequencies suitable for the frequency divider.

7. Arrangement according to claim 6, characterized in that the frequency comparator arrangement comprises a frequency calculator for determining the frequency at the output of the frequency divider, and a memory for storing frequencies suitable for the frequency divider and a comparator circuit for comparing the frequency found with suitable frequencies and controlling the second breaker on the basis of the result.

8. Arrangement according to claim 6, characterized in that the frequency comparator arrangement comprises a first monostable multi-vibrator in series with a first D flip-flop and a second monostable multi-vibrator in series with a second D flip-flop, which first multi-vibrator is designed with a pulse length defining a lower limit frequency and which second multi-vibrator is designed with a pulse length defining an upper limit frequency for frequencies suitable for the frequency divider.

9. Arrangement according to claim 8, characterized in that the pulse lengths of the multi-vibrators are determined by a resistor and a capacitor arranged externally at the input of each multi-vibrator.

10. Arrangement according to claim 1, characterized in that the primary side of the transformer comprises a winding with a centre tap connected to the direct-voltage source, which winding is connected symmetrically in series with the first breaker and a further breaker.

11. The arrangement according to claim 1, wherein the energy-storing arrangement comprises an ignition capacitor for use in an electronic ignition system.

12. An arrangement for charging energy in an energy-storing arrangement, which energy-storing arrangement is connected to a secondary side of a transformer, a primary side of the transformer is connected to a direct-voltage source in series with a first breaker controlled by a pulse train, characterized in that, for generating the pulse train for controlling the first breaker, a signal generator and a frequency divider controlled by environmental conditions of an electronic ignition system, connected to the signal generator, are included, wherein the primary side of the transformer comprises a winding with a center tap connected to the direct-voltage source, and wherein the winding is connected symmetrically in series with the first breaker and a further breaker.

13. The arrangement according to claim 12, wherein the energy storing arrangement comprises an ignition capacitor for use in the electronic ignition system.

* * * * *